US005726528A

United States Patent [19]

Jansma et al.

[11] Patent Number: 5,726,528

[45] Date of Patent: Mar. 10, 1998

[54] FLUORESCENT LAMP HAVING REFLECTIVE LAYER

[75] Inventors: Jon B. Jansma, Pepper Pike; Thomas F. Soules, Richmond Heights, both of Ohio

[73] Assignee: General Electric Company, Schenectady, N.Y.

[21] Appl. No.: 699,284

[22] Filed: Aug. 19, 1996

[51] Int. Cl.[6] ..... H01J 1/62; H01J 65/00

[52] U.S. Cl. ..... 313/489; 313/486; 315/344

[58] Field of Search ..... 313/489, 486, 313/493, 562, 635, 638, 640, 160, 161; 315/248, 344

[56] References Cited

U.S. PATENT DOCUMENTS

| | | | |
|---|---|---|---|
| 3,225,241 | 12/1965 | Spencer, et al. | 313/489 |
| 3,995,191 | 11/1976 | Kaduk et al. | 313/489 |
| 4,069,441 | 1/1978 | Wanamaker et al. | 313/487 |
| 4,079,288 | 3/1978 | Maloney et al. | 313/489 |
| 4,289,991 | 9/1981 | Schreurs | 313/489 |
| 4,670,688 | 6/1987 | Sigai et al. | 313/489 |
| 4,797,594 | 1/1989 | Sigai et al. | 313/489 |
| 4,872,741 | 10/1989 | Dakin et al. | 313/483 |
| 4,882,520 | 11/1989 | Tsunekawa et al. | 313/643 |
| 4,924,141 | 5/1990 | Taubner et al. | 313/489 |
| 4,959,584 | 9/1990 | Anderson | 313/160 |
| 5,008,789 | 4/1991 | Arai et al. | 313/489 |
| 5,258,689 | 11/1993 | Jansma et al. | 313/489 |
| 5,309,069 | 5/1994 | Sigai et al. | 313/489 |
| 5,402,032 | 3/1995 | Allen et al. | 315/3.5 |
| 5,412,280 | 5/1995 | Scott | 313/573 |
| 5,461,284 | 10/1995 | Roberts et al. | 315/57 |
| 5,512,798 | 4/1996 | Honda | 313/489 |
| 5,602,444 | 2/1997 | Jansma | 313/489 |

FOREIGN PATENT DOCUMENTS

| | | |
|---|---|---|
| 0 385 275 | 9/1990 | European Pat. Off. . |

*Primary Examiner*—George M. Dombroske
*Assistant Examiner*—Harshad Patel
*Attorney, Agent, or Firm*—George E. Hawranko

[57] ABSTRACT

A reflector fluorescent lamp with a reflective layer between the light-transmissive envelope and the phosphor layer(s). The reflective layer has a coating weight of at least 5, more preferably 6–8, mg/cm$^2$ and is a blend of gamma alumina and alpha alumina, preferably 7–80 weight percent gamma alumina and 20–93 weight percent alpha alumina, more preferably 30–40 weight percent gamma alumina and 60–70 weight percent alpha alumina. The reflective layer finds particular utility in an electrodeless fluorescent lamp.

11 Claims, 1 Drawing Sheet

FLUORESCENT LAMP HAVING REFLECTIVE LAYER

BACKGROUND OF THE INVENTION

1. Field of the Invention

The present invention relates generally to fluorescent lamps and more particularly to a fluorescent lamp having an improved reflective layer.

2. Description of Related Art

There are several types of reflector fluorescent lamps, including electrodeless reflector fluorescent lamps and fluorescent lamps with directed beams. Reflector fluorescent lamps employ a fine powder reflective coating over a portion of the inside of the glass surface which may already be coated with conductive coatings and precoats. This reflective coating is then covered with the luminescent phosphor coating. The reflective coating serves to reflect visible light generated by the phosphor coating back through the phosphor layer to the inside of the lamp. Light is allowed out of the lamp only from the area which is not coated with the reflective layer. Thus, reflector fluorescent lamps efficiently direct the light generated.

The generally used prior art reflector coating for fluorescent lamps is a relatively thick layer of finely divided titania. This titania coating is a very effective scatterer or reflector of visible light. However, ultraviolet radiation from the discharge inside the fluorescent lamp which is not absorbed by the phosphor coating over the titania will be absorbed by the titania and lost. This can be avoided by use of a thick layer of phosphor, but this is expensive. It has also, been suggested to use certain alumina powder coatings instead of titania powder coatings. Alumina powder coatings have an advantage over titania powder coatings in that alumina powder coatings reflect both visible and ultraviolet radiation. However, the alumina powder coatings which have been suggested have suffered from various deficiencies, including insufficient reflectance.

Accordingly, there is a need for a reflective layer for reflector fluorescent lamps which more efficiently and more effectively reflects visible light and ultraviolet radiation back through the phosphor layer towards the interior of the lamp so that the ultraviolet radiation may be converted by the phosphor coating into visible light and so that the visible light may leave the lamp in the desired direction.

SUMMARY OF THE INVENTION

A fluorescent lamp comprising a sealed light-transmissive envelope having an inner surface and containing a metal and an inert gas, means for providing a discharge, a reflective layer adjacent a portion of the inner surface of the envelope, and a phosphor layer adjacent the reflective layer. The reflective layer is between the envelope and the phosphor layer, the reflective layer having a coating weight of at least 5 mg/cm$^2$, the reflective layer comprising a blend of gamma alumina and alpha alumina, the alumina blend being 7–80 weight percent gamma alumina and 20–93 weight percent alpha alumina.

DETAILED DESCRIPTION OF THE PREFERRED EMBODIMENTS OF THE INVENTION

Figure 1:
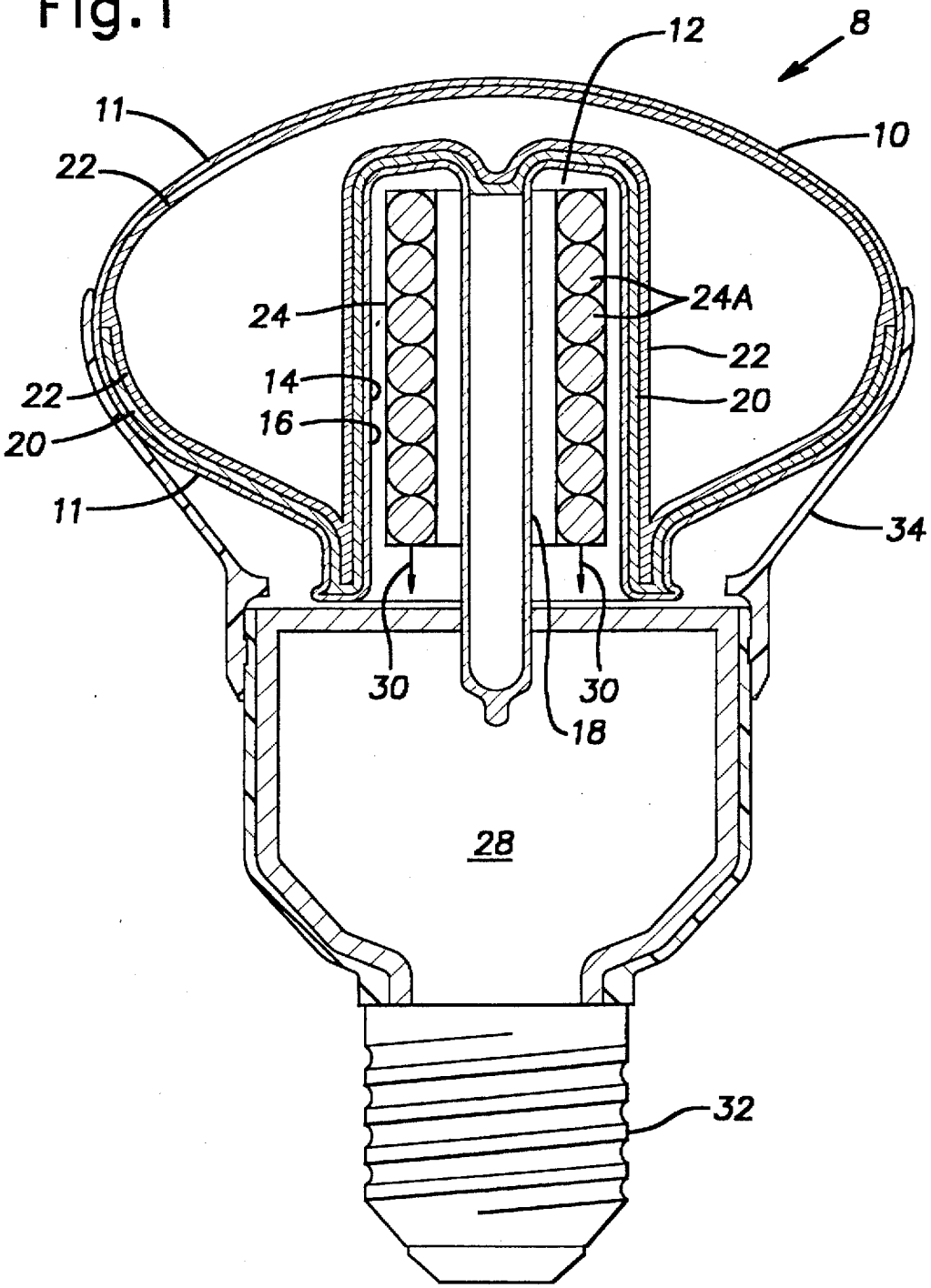
FIG. 1 is an elevational view in cross section of an electrodeless fluorescent lamp employing the present invention.

With reference to FIG. 1, there is shown a representative electrodeless fluorescent lamp 8. Electrodeless fluorescent lamps are generally well-known in the art. Lamp 8 includes a sealed light-transmissive envelope or vitreous envelope 10, such as soda-lime-silicate glass, that is hermetically sealed and that contains a metal vapor or metal, such as mercury, and an inert gas, such as argon. Envelope 10 is shaped with an external chamber 12 for receiving an electrical excitation coil 24. Coil 24 is shown with coil turns 24A whose cross sections are exaggerated in size. Coil 24 has a cylindrical shape, and a hollow interior through which stem 18 of vitreous envelope 10 extends. Coil 24 is electrically coupled to power supply, or ballast, circuit 28 via conductors 30, only part of which are shown; ballast circuit 28 is shown in schematic form as merely a block. Ballast circuit 28, in turn, is coupled to receive alternating current power from electrical supply means via a screw-type base 32. Thus the lamp has a means for providing a discharge. If the lamp were an electroded fluorescent lamp, the means for providing a discharge includes a pair of spaced electrodes and related elements as are known in the art.

External chamber 12 defines central column 14 of envelope 10. Central column 14 has an outer wall 16; stem 18 depends from the top of column 14. Plastic skirt 34 helps to protect vitreous envelope 10 and hold it in position. Vitreous envelope 10 has an oval portion 11, a central column 14, and a stem 18. Inner conductive coatings, outer conductive coatings and other such coatings or precoats as are known in the art may be applied to vitreous envelope 10.

As shown in FIG. 1, reflective coating or layer 20 of the present invention is applied adjacent the outer wall 16 of central column 14, slightly down into stem 18, and adjacent the inner surface of the lower half of oval portion 11 of envelope 10 up to the widest portion of the oval. A phosphor coating or layer 22 as is known in the art is applied over the reflective layer 20 and also adjacent the inside surface of the upper half of oval portion 11. Note that reflective layer 20 is not coated on the upper half of oval portion 11 of envelope 10, so that visible light may exit therethrough. The general construction and operation of electrodeless fluorescent lamps is known in the art and the contents and drawings of U.S. Pat. Nos. 5,412,280 and 5,461,284 are incorporated herein by reference in their entirety. The reflective layer of the present invention can also be used in an electroded or electrodeless fluorescent lamp, such as a low pressure mercury vapor discharge lamp having a pair of spaced electrodes, such as one with a directed light beam, such as an electroded fluorescent tube with a slit, such as is disclosed and illustrated in U.S. Pat. No. 4,924,141, the contents of which are incorporated herein by reference in their entirety, or in other reflector fluorescent lamps.

Phosphor layer 22 is preferably a rare earth phosphor layer, such as a rare earth triphosphor layer, but it may also be any other phosphor layer as known in the art. Multiple phosphor layers may also be provided.

The reflective layer of the present invention beneficially reflects ultraviolet light back into the phosphor layer or layers where it may be utilized, leading to improved phosphor utilization and more efficient production of visible light. The reflective layer also reflects visible light back into the lamp where it may exit in the desired direction.

Reflective layer 20 is or contains a blend of gamma alumina particles and alpha alumina particles. The gamma alumina particles have a surface area of 30–140, more preferably 50–120, more preferably 80–100, more preferably 90–100, m$^2$/gm and a particle size (diameter) of preferably 10–500, more preferably 30–200, more preferably 50–100, nm. The alpha alumina particles have a surface area of 0.5–15, more preferably 3–8, more preferably 4–6, more preferably about 5, $m^2$/gm and a particle size (diameter) of preferably 50–5000, more preferably 100–2000, more preferably 500–1000, more preferably about 700, nm.

The alumina particle blend in the reflective layer 20 is 7–80, more preferably 10–65, more preferably 20–50, more preferably 30–40, more preferably about 35, weight percent gamma alumina and 20–93, more preferably 35–90, more preferably 50–80, more preferably 60–70, more preferably about 65, weight percent alpha alumina. Preferred blends include 40% gamma/60% alpha and 30% gamma/70% alpha.

The reflective layer 20 is provided on the lamp as follows. The gamma alumina and alpha alumina particles are blended by weight. The particles should be substantially pure or of high purity substantially without light-absorbing impurities or with a minimum of light-absorbing impurities. The alumina is then dispersed in a water vehicle with a dispersing agent such as ammonium polyacrylate and optionally other agents known in the art. The suspension is then applied as a coating to the desired surface, such as shown in FIG. 1, and heated, which is known in the art. In the heating stage the non-alumina components are driven off, leaving only the alumina behind. The reflective layer 20 is applied so that the weight of alumina in the reflective layer (the "coating weight") is at least 5, more preferably 5.5–10, more preferably 6–8, more preferably about 7, mg of alumina per $cm^2$.

The following Examples further illustrate various aspects of the invention. All percentages are weight percent unless otherwise indicated.

EXAMPLE 1

A test was conducted using electrodeless fluorescent lamps similar to that illustrated in FIG. 1. Lumens were measured at 100 hours (n=4). No. 1 had a titania reflective layer (8 mg/$cm^2$) and measured 1068 lumens. No. 2 had a reflective layer of a blend of 60% alpha alumina and 40% gamma alumina (coating weight of 8 mg/$cm^2$) and measured 1125 lumens, a surprising 5.3% improvement.

EXAMPLE 2

Alumina coatings were applied on flat glass slides and diffuse reflectance of 254 nm ultraviolet light was measured using a SPEX double grating scanning spectrophotometer. Coating weight is in mg/$cm^2$. The reflectance values (in %) are relative to a barium sulfate standard at 254 nm. Sample A is 99% alpha alumina (4–6 $m^2$/gm surface area). Sample B is 60% alpha alumina (4–6 $m^2$/gm surface area) and 40% gamma alumina (90–100 $m^2$/gm surface area).

| Coating Weight | Reflectance of Sample A | Reflectance of Sample B |
|---|---|---|
| 4.0 | 90% | 99% |
| 5.0 | 93% | 99% |
| 6.0 | 95% | 99.5% |
| 7.0 | 96% | 100% |
| 8.0 | 97% | 100% |
| 9.0 | 98% | 100% |
| 10.0 | 99% | 100% |

Diffuse reflectance values of 99% are preferred for the reflective layer, such as the reflective layer of an electrodeless reflector-type fluorescent lamp as shown in FIG. 1. As can be seen, the invention has greater reflectance. This was surprising and unexpected.

Although the preferred embodiments of the invention have been shown and described, it should be understood that various modifications and rearrangements may be resorted to without departing from the scope of the invention as disclosed and claimed herein.

What is claimed is:

1. A fluorescent lamp comprising a sealed light-transmissive envelope having an inner surface and containing mercury and an inert gas, means for providing a discharge, a reflective layer adjacent a portion of the inner surface of said envelope, and a phosphor layer adjacent said reflective layer, said reflective layer being between said envelope and said phosphor layer, said reflective layer having a coating weight of at least 5 mg/$cm^2$, said reflective layer comprising a blend of gamma alumina and alpha alumina, said alumina blend being 7–80 weight percent gamma alumina and 20–93 weight percent alpha alumina.

2. A fluorescent lamp according to claim 1, wherein said alumina blend is 20–50 weight percent gamma alumina and 50–80 weight percent alpha alumina.

3. A fluorescent lamp according to claim 2, wherein said alumina blend is 30–40 weight percent gamma alumina and 60–70 weight percent alpha alumina.

4. A fluorescent lamp according to claim 1, wherein said reflective layer has a coating weight of 6–8 mg/$cm^2$.

5. A fluorescent lamp according to claim 1, wherein said fluorescent lamp is an electrodeless fluorescent lamp.

6. A fluorescent lamp according to claim 5, said envelope comprising an oval portion having a lower half and an upper half, a central column having an outer wall, and a stem, said reflective layer being at least adjacent (a) the outer wall of the central column and (b) the lower half of the oval portion, said phosphor layer being disposed over said reflective layer and also adjacent the upper half of the oval portion.

7. A fluorescent lamp according to claim 6, said alumina blend being 30–40 weight percent gamma alumina and 60–70 weight percent alpha alumina, said reflective layer having a coating weight of 6–8 mg/$cm^2$ and consisting essentially of said alumina blend.

8. A fluorescent lamp according to claim 1, wherein said phosphor layer is a rare earth phosphor layer.

9. A fluorescent lamp according to claim 1, said gamma alumina having a surface area of 80–100 $m^2$/gm and said alpha alumina having a surface area of 4–6 $m^2$/gm.

10. A fluorescent lamp according to claim 1, said lamp being a low pressure mercury vapor discharge lamp having a pair of spaced electrodes.

11. A fluorescent lamp according to claim 1, said reflective layer consisting essentially of a blend of gamma alumina and alpha alumina, said alumina blend being 10–65 weight percent gamma alumina and 35–90 weight percent alpha alumina.

* * * * *

UNITED STATES PATENT AND TRADEMARK OFFICE

CERTIFICATE OF CORRECTION

PATENT NO. : 5,726,528
DATED : March 10, 1998
INVENTOR(S) : Jon B. Jansma et al.

It is certified that error appears in the above-identified patent and that said Letters Patent is hereby corrected as shown below:

Title page,
Between Item [73] and Item [21], insert the following item:
-- [*] Notice: The portion of the term of this patent subsequent to August 28, 2015, has been disclaimed. --

Signed and Sealed this

Twenty-fifth Day of February, 2003

JAMES E. ROGAN
*Director of the United States Patent and Trademark Office*